US010319163B2

(12) United States Patent
Murphy

(10) Patent No.: US 10,319,163 B2
(45) Date of Patent: Jun. 11, 2019

(54) REMOTE CONTROL UNLOCKING AND LOCKING SYSTEM

(71) Applicant: Matthew Murphy, Wellesley, MA (US)

(72) Inventor: Matthew Murphy, Wellesley, MA (US)

( * ) Notice: Subject to any disclaimer, the term of this patent is extended or adjusted under 35 U.S.C. 154(b) by 0 days.

(21) Appl. No.: 14/327,946

(22) Filed: Jul. 10, 2014

(65) Prior Publication Data

US 2015/0015362 A1 Jan. 15, 2015

Related U.S. Application Data

(60) Provisional application No. 61/844,539, filed on Jul. 10, 2014, provisional application No. 61/862,192, filed on Aug. 5, 2014.

(51) Int. Cl.
*G07C 9/00* (2006.01)

(52) U.S. Cl.
CPC ..... *G07C 9/00126* (2013.01); *G07C 9/00174* (2013.01); *G07C 2009/00746* (2013.01); *G07C 2009/00841* (2013.01)

(58) Field of Classification Search
CPC ..... G07C 2009/00746; G07C 9/00126; G07C 9/00174; G07C 2009/00753; G07C 9/00182; G07C 9/00007; G07C 9/00309; E05B 59/00; E05B 63/0004
USPC ..... 340/5.3, 5.1, 543, 407.1, 5.2, 5.67, 5.7; 70/278.1
See application file for complete search history.

(56) References Cited

U.S. PATENT DOCUMENTS

| | | | | |
|---|---|---|---|---|
| 6,411,195 | B1 * | 6/2002 | Goldman | G07C 9/00182 340/407.1 |
| 6,556,124 | B1 * | 4/2003 | Laroche | B60R 25/20 307/10.2 |
| 2007/0229257 | A1 * | 10/2007 | Bliding | E05B 49/00 340/566 |
| 2008/0136678 | A1 * | 6/2008 | Harrington | G06F 3/043 341/20 |
| 2014/0285320 | A1 * | 9/2014 | Blackmer | B60R 25/23 340/5.72 |
| 2015/0102609 | A1 * | 4/2015 | Johnson | E05B 1/0007 292/144 |
| 2015/0123762 | A1 * | 5/2015 | Park | G07C 9/00182 340/5.51 |

* cited by examiner

*Primary Examiner* — Mirza F Alam
(74) *Attorney, Agent, or Firm* — Bay State IP, LLC

(57) ABSTRACT

A portable, temporary removable system for locking and unlocking a door knob, door lever or locking deadbolt without the requirement of using keyed entry. Several manners of automated locking and unlocking are introduced and the instant system is designed for quick installation and removal. Once attached, the system may be remotely controlled from the outside of the door via a pattern of knocks, via electronic communications or a combination of a knock pattern and electronic communication.

18 Claims, 6 Drawing Sheets

REMOTE CONTROL UNLOCKING AND LOCKING SYSTEM

CROSS REFERENCE TO RELATED APPLICATION

This application claims the benefit of and takes priority from U.S. Provisional Application No. 61/844,539 filed on Jul. 10, 2013 and U.S. Provisional Application No. 61/862,192 filed on Aug. 5, 2013, the contents of which are hereby incorporated by reference.

BACKGROUND OF THE INVENTION

Field of the Invention

The present invention relates to a keyless and remote access controlled locking and unlocking system.

Description of the Related Art

Keyed entry door knobs and door levers are commonly used to restrict access to homes, businesses and other structures. These door knobs and door levers contain an internal lock mechanism which includes a keyed lock, accessible on the exterior of the door and a finger-operated rotational lock/unlock mechanism, accessible on the interior of the door. The interior finger-operated rotational lock/unlock mechanism is designed to be actuated by human fingers and is designed such that users do not need a key to lock or unlock the door knob or door lever from the interior of the door.

When operating a door knob or door lever from the exterior, a key is required to be inserted into the exterior lock mechanism and rotated in order to gain access to the locked area. Keys are costly to reproduce and the method of duplicating keys is often inaccurate and imprecise, resulting in keys that do not properly open the lock. Keys can be easily lost reducing the security of the device. In addition, locking door knobs and door levers allow for only one key pattern per door knob or door lever so it is not possible to offer different types of access control to different users.

Electronic and mechanical doorknobs containing a numerical or alphanumeric keypad currently exist which allow users to enter a password or numerical code in order to unlock the door knob locking mechanism. Additionally, systems exist which allow a door knob or door level to be controlled remotely via wireless communications and via the internet. These current designs are required to be permanently installed in the door and are clearly visible from the outside of the door.

Key lockboxes are currently in use which allows users to lock a key in a protective box in close proximity to the keyed entry doorknob. Most key lockboxes are accessed by entering a numeric or alphanumeric combination on the outside of the box structure. Some electronic lockboxes open via communication with smartphones or other electronic devices. These key lockboxes allow multiple users possessing the lockbox combination or electronic access privileges to gain access to the key inside the box. The user then takes possession of the key in order to insert it into the exterior of the door knob or door lever locking mechanism in order to unlock the lock mechanism. This approach allows several users to share a single key within the lockbox but it is a cumbersome and time consuming process. In addition, security is reduced because every user with lockbox access takes possession of the physical key for a period of time.

Thus, it is possible for users to duplicate the key during the time they possess it. Once a user takes possession of a key, it is impossible to be certain that access has been revoked unless the key pattern of the lock is physically changed or the entire door knob or door lever is replaced. In addition, users may forget to return the key to the lockbox.

What is needed is a device which can be temporarily attached to the door knob or door lever on the inside of the door in order to actuate the rotational lock/unlock mechanism and which can be remotely operated from the outside of the door without the use of a key.

SUMMARY OF THE INVENTION

The instant invention, as illustrated herein, is clearly not anticipated, rendered obvious, or even present in any of the prior art mechanisms, either alone or in any combination thereof.

Therefore, it is an object of the instant invention to allow a standard locking door knob or door level to have a system temporarily attached to it to allow for remote locking/unlocking without a key and from the outside of the locked door. This will lead to savings in time and money, more flexible access control and greater security by removing the limitations and vulnerabilities of physical keys.

It is a further object of the instant invention to provide a temporary keyless lock/unlocking system which is not visible from the outside of the locked door.

It is a further object of the instant invention to provide the user a way to interact with the system either through electronic wireless data communications such as via a networked smartphone or other wireless communications device or the user may interact with the system by using their hand to knock a pattern of knocks on the outside of the door which are interpreted and compared with a knock pattern stored within the memory of the system in order to validate the knock pattern or the system may access an external application to validate the knock pattern. A combination of knock pattern recognition and wireless communication may also be used to provide two layers of security and flexibility.

In this respect, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

DETAILED DESCRIPTION OF THE INVENTION

Figure 1:
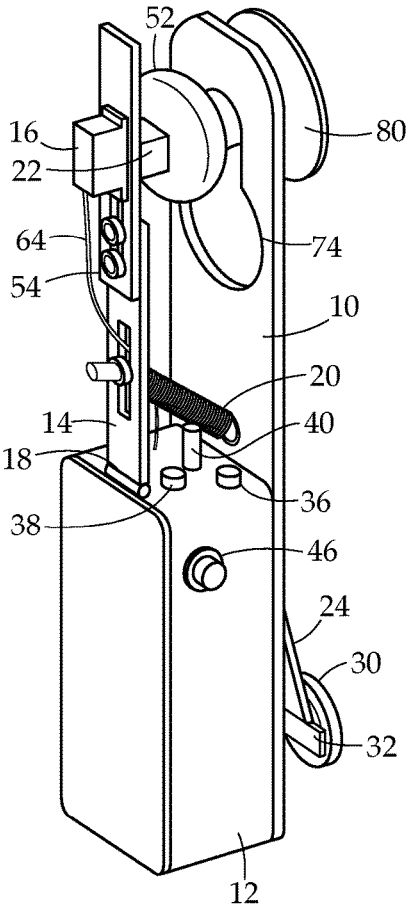
FIG. 1 is a right side view of the invention mounted to a standard doorknob.

The detailed description set forth below is intended as a description of presently preferred embodiments of the invention and does not represent the only forms in which the present invention may be construed and/or utilized. The description sets forth the functions and the sequence of the steps for producing the system and accompanying apparatus. However, it is to be understood that the same or equivalent functions and sequences may be accomplished by different embodiments also intended to be encompassed within the scope of the invention.

FIGS. 1-5 and 9 depict various viewpoints of the present invention and the electronics container 12. The present invention includes a frame 10 which allows the device to be easily and quickly attached to a standard door knob 52 or door lever. It includes an electronics container for housing the electronic components such as internal memory 68, batteries 70, micro controller 66, network interface device 72, lights, audio devices and switches necessary for the device to interpret input from the user and to present audio and visual feedback to the user. Software stored within the micro controller 66 determines the behavior of the system. The electronics container 12 includes a power switch 46, a rotational direction switch 48, a knock validation mode switch 42, and an audio mode switch 44. The top surface of the electronics container 12, contains a programming switch 50, a programming indicator light 34, a status indicator light 36 and a network connectivity indicator light 38 to indicate when the device is connected to LAN or WAN networks via WiFi or cellular connection. A knock sensitivity adjustment knob 40 is mounted within the top surface of the electronics container 12.

A servo tension arm 14 is mounted to the top surface of the electronics container 12 via a servo tension arm hinge 18. A servo tension arm spring 26 is connected between the servo tension arm 14 and the frame 10 in order to provide pressure between the servo tension arm 14 and the door knob 52 when the frame 10 is mounted on the door knob 52. The servo tension arm 14 is made from two sections of rigid material attached to each other by way of bolts mounted within a servo tension arm length adjustment slot 54. This servo tension arm length adjustment slot 54 allows the relative position of the two sections to be changed causing the length of the servo tension arm 14 to be adjusted to compensate for different types and sizes of door knobs 52 and allow the end of the servo tension arm 14 to maintain proper alignment to the door knob 52. The end of the servo tension arm 14 contains a slot to mount a servo motor 16 so that the rotational axis of the servo motor 16 aligns with the rotational axis of the finger-operated rotational lock/unlock mechanism 56 within the door knob 52. A lock mechanism mating coupler 22 is mounted to the rotational axis of the servo motor 16. The servo mating coupler 22 is shaped to fit the contour of the finger-operated rotational lock/unlock mechanism 56 within the door knob 52 and transfer the rotational force of the servo motor 16 to the finger operated rotational lock/unlock mechanism 56. The servo motor 16 is connected electronically to a micro controller 66 within the electronics container 12 via servo motor wires 64. Software within the micro controller 66 controls the behavior of the servo motor 16 as well as all other electronic components of the system.

A piezo tension arm 24 is mounted to the back side of the frame 10 via a piezo tension arm hinge 28. A piezo tension arm spring 26 is mounted between the frame 10 and the piezo tension arm 24 so that the piezo tension arm 24 is kept tensioned against the door 60. A piezo knock detector 30 is mounted to the end of the piezo tension arm 24 via a piezo tension arm hinge 28. The piezo tension arm hinge 28 allows the piezo knock detector 30 to pivot and ensures that the maximum surface area of the piezo knock detector 30 remains in contact with the door 60. The piezo knock detector 30 converts the vibrations resulting from knocking on the door 60 into electrical current which is transferred via piezo knock detector wires 62 to be analyzed by the micro controller 66 within the electronics container 12.

A user attaches the system to a door knob 52 by pulling forward on the servo tension arm 14 and maneuvering the wide portion of the frame's 10 slotted door knob mounting hole 74 so that the door knob protrudes through the wide portion of the slotted door knob mounting hole 74. Once the door knob is protruding through the slotted door knob mounting hole 74 in the frame 10, the frame 10 is maneuvered downward so that the frame 10 comes to rest with the door knob stem 80 seated in the narrow slot of the slotted door knob mounting hole 74. The servo tension arm 14 is then allowed to spring forward so that the servo mating coupler 22 comes to rest in direct contact with the finger operated rotational lock/unlock mechanism 56 of the door knob 52.

In order to use the system, a user selects the desired knock sensitivity threshold by turning the knock sensitivity adjustment knob 40. The user then switches on the power switch 46. Users interact with the system by knocking a pattern of knocks on the outside of the door 60 using their hand 76 or any other knocking device which will generate a vibration on the door 60. The goal of the knock sensitivity adjustment knob 40 is to filter out background vibrations to prevent the system from interpreting background vibrations as knocks. Vibrations above the desired threshold will be interpreted as knocks. Vibrations below the desired threshold will be ignored.

Figure 2:
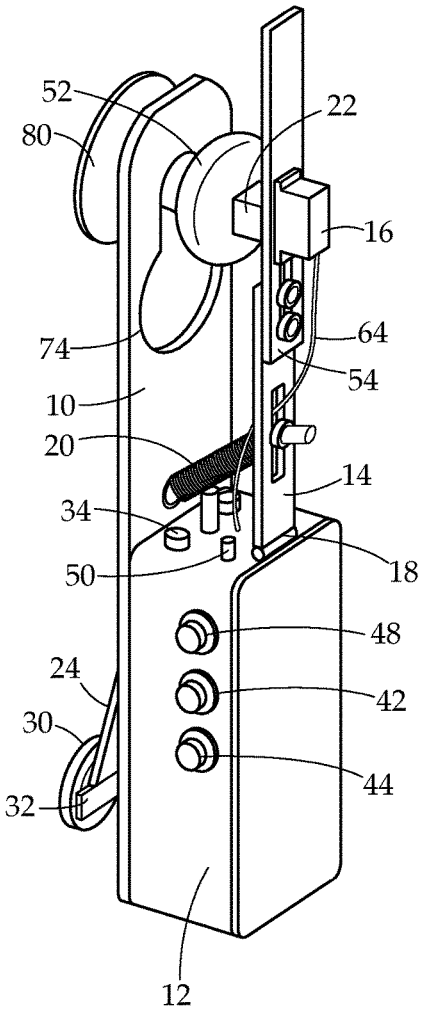
FIG. 2 is a left side view of the invention mounted to a standard doorknob.
Figure 5:
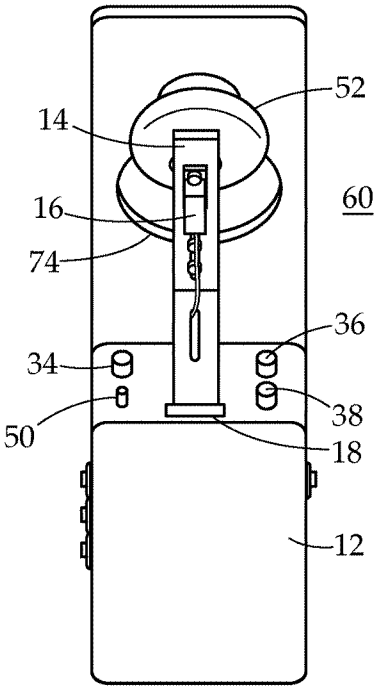
FIG. 5 is a top view of the invention.
Figure 3:
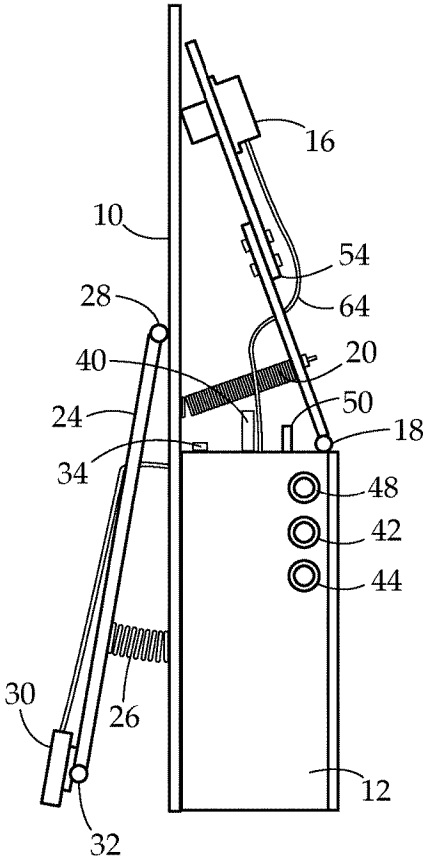
FIG. 3 is a left side view of the invention.

FIGS. 2 and 3 depict side views of the system wherein a user may select two modes on the knock validation mode switch 42. The two modes are "memory" or "external". In "memory" mode, the micro controller 66 within the system will compare a user's submitted knock pattern with a knock pattern stored within the system's internal memory 68. If the knock pattern input by the user matches the pattern stored within internal memory 68, the knock pattern is considered valid and the servo motor 16 will turn the servo mating coupler 22 which will turn the finger operated rotational lock/unlock mechanism 56 and the door knob 52 will be unlocked and access will be granted to the user. If the knock validation mode switch 42 is set to "external", prior to the validation of the user's knock pattern against the knock pattern stored within internal memory 68, the system will initiate an HTTP request to an external application 78 to determine if access has been authorized via the external application 78. Software contained within the micro controller 66 will interpret the HTTP response from the external application 78 to determine if access has been authorized from within the external application 78. If access is authorized from the external application 78, the micro controller 66 will initiate a rotation of the servo motor 16 to turn the servo mating coupler 22 which will turn the finger operated rotational lock/unlock mechanism 56 and the door knob 52 will be unlocked. If the content of the HTTP response does not include authorization from the external application 78, the knock is not validated and the access does not proceed.

An external application 78 could be any application capable of responding to HTTP requests from a client. External applications 78 would be expected to be built with robust security and user authentication features with the ability to allow users of the external application 78 to manage access rules and user roles related to users' devices. The rules regarding how, when, and if validation should occur would be managed within the external application 78. An external application 78 could allow users to manage access for multiple users and multiple devices.

The network connectivity indicator light 38 indicates the status of the network connection when the knock validation mode switch 42 is set to "external". If a useable network connection is detected, the network connectivity indicator light 38 illuminates. If no connection is present the network connectivity indicator light 38 will not illuminate. If there are errors with the network connection, the network connectivity indicator light 38 may blink a pattern to indicate the type of error.

The audio mode switch 44 controls whether the system generates audio tones to communicate failed or successful access attempts. If the audio mode switch 44 is on, audio tones will be generated to provide audio feedback for successful knock validation and failed knock validation.

The status indicator light 36 indicates different statuses of the system depending on blink patterns.

The programming switch 50 allows a user to input and store a new knock pattern into the internal memory 68. When the programming switch 50 is switched on, the programming indicator light 34 will illuminate. The user may then knock a pattern of knocks. The user's knock pattern will be interpreted by the piezo knock detector 30 and transferred to the micro controller 66 via the piezo knock detector wires 62. The micro controller 66 will store the new knock pattern within the internal memory 68 as the user knocks on the door 60 with their hand as long as the programming switch 50 remains in the on position. When the programming switch 50 is released, the new knock pattern is stored to internal memory 68 and the programming indicator light 34 is turned off.

Figure 4:
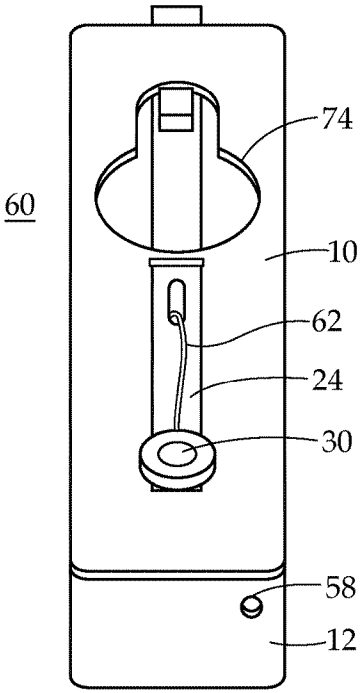
FIG. 4 is a bottom view of the invention.

FIG. 4 depicts a USB port 58 mounted within the bottom surface of the electronics container 12 to allow for software updates via an external computer.

Figure 6:
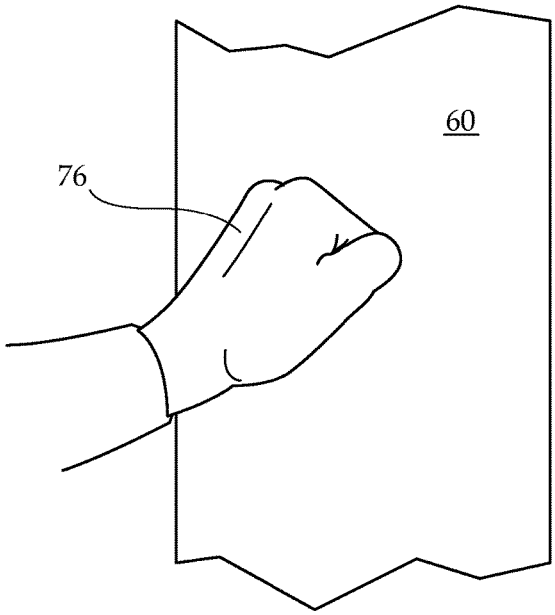
FIG. 6 is a person knocking on a door to interact with the invention.

FIG. 6 depicts a mode of operation wherein one may use a hand 76 or other means to provide pressure to a structure, such as a door 60 to provide pressure to the piezo knock detector 30.

Figure 7:
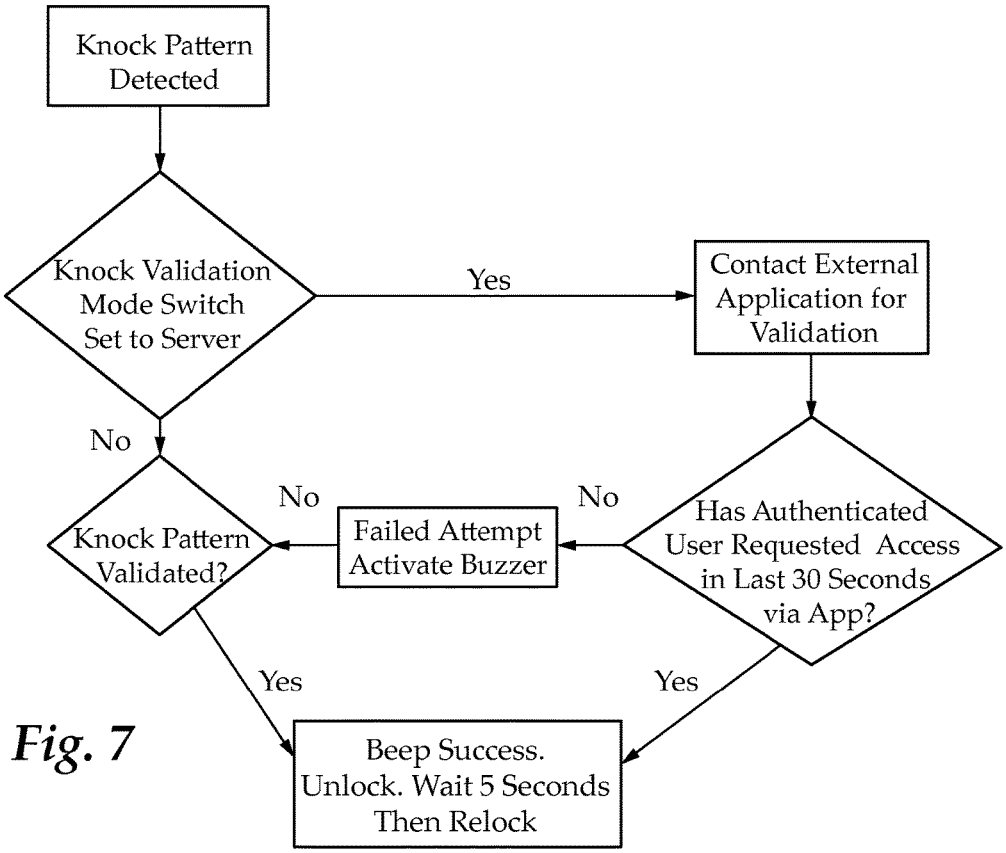
FIG. 7 is a flow chart which illustrates the two modes of granting access in response to knock patterns.
Figure 8:
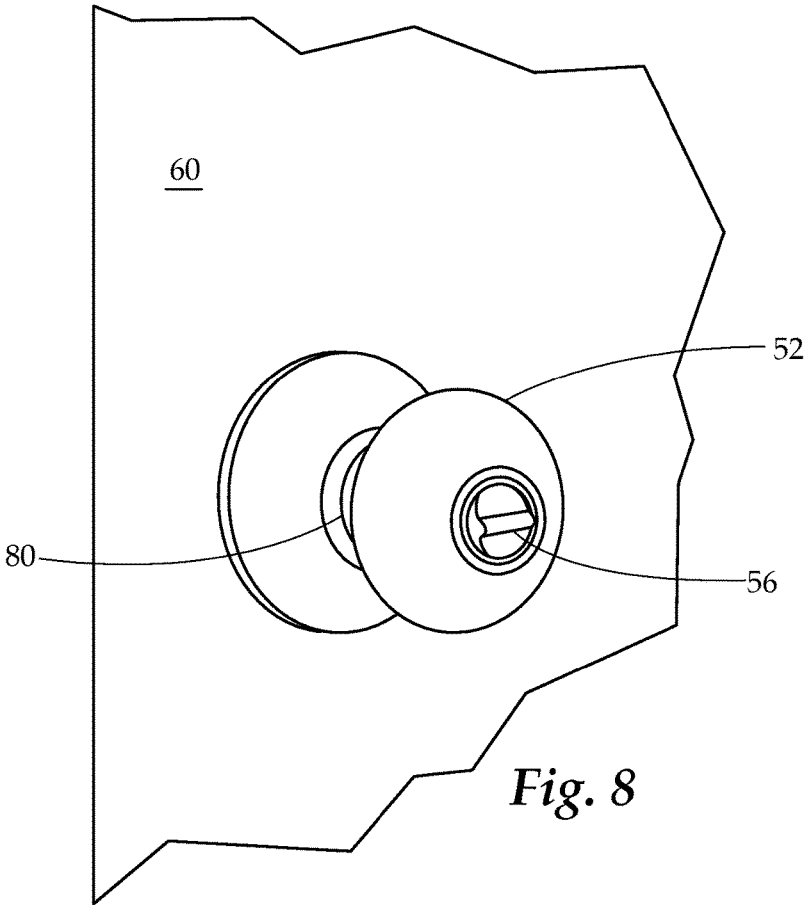
FIG. 8 is an interior view of a standard keyed entry door knob typically found on the exterior doors of homes, businesses and other structures.
Figure 9:
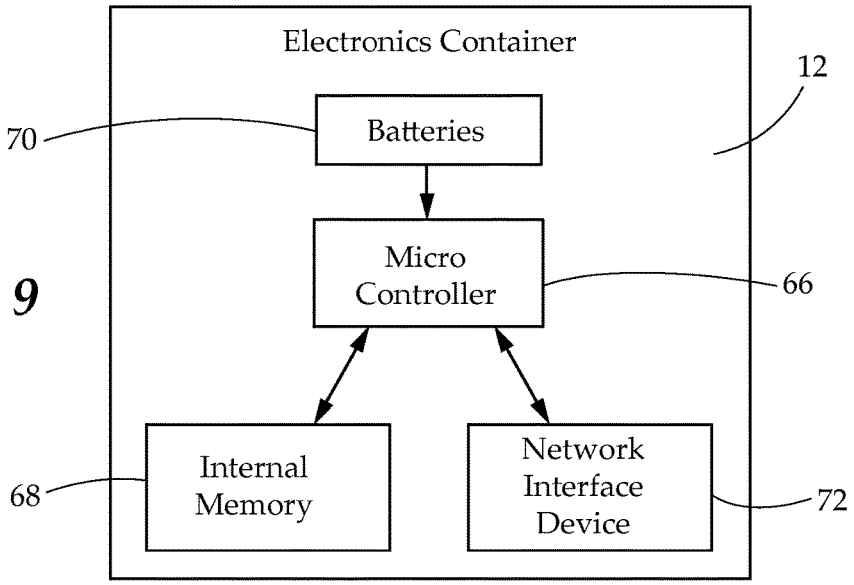
FIG. 9 is a view of the electronic components contained within the electronics container.

FIG. 7 illustrates the logical flow of behavior when a user knocks a sequential pattern of knocks on the door 60. The knock vibrations are detected individually by the piezo knock detector 30 and are converted into electrical energy and transferred via the piezo knock detector wires 62 to the micro controller 66 within the electronics container 12. The time durations between knocks are analyzed to define a knock pattern. If the time between knocks exceeds a pre-defined value, it is assumed that the user has completed inputting their knock pattern and the preceding sequence of knocks is considered a pattern submitted by the user. If the knock validation mode switch 42 is set to "external", a network interface device 72 is utilized to generate an HTTP request to an external application 78 for validation. Software contained within the micro controller 66 will interpret the HTTP response from the external application 78 to determine if access has been authorized within the external application. If the HTTP response indicates that the access is authorized, the knock is considered validated regardless of the knock pattern input by the user.

In this instance, the external application 78 is being relied upon to provide security. If the knock validation mode switch 42 is set to "memory" no HTTP request is generated. Instead, software within the micro controller 66 analyzes the user's knock pattern and compares the pattern against the pattern stored within internal memory 68 for validation. In "memory" mode, if the user's submitted knock pattern matches the pattern stored within internal memory, the knock is considered validated. Once a knock is validated, the micro controller 66 commands the servo motor 16 to turn the servo mating coupler 22 thereby turning the finger operated rotational lock/unlock mechanism 56 on the door knob 52.

The servo motor's 16 direction of rotation is controlled by the rotational direction switch 48 which controls whether the servo motor's 16 rotation is clockwise or counter clockwise. Different door knob 52 lock mechanisms currently on the market will require either a clockwise or counter clockwise rotational direction to unlock. Depending on the position of the audio mode switch 44, an audio tone may accompany the rotation of the servo motor 16 in order to communicate a successful validation. After a pre-defined period of time after rotating the servo motor 16 to unlock, the servo motor 16 will turn in the opposite direction to re-lock the finger operated lock/unlock mechanism 56 to restrict further access.

If a knock pattern is not validated, the servo motor 16 will not rotate and access is not granted. Depending on the position of the audio mode switch 44, an audio tone may accompany the failed validation in order to indicate a failed access attempt.

In an alternative embodiment the system may be attached to a door knob or door lever in a different manner from what has been described.

In an alternate embodiment an LCD screen and additional buttons and user interface devices may be attached to the system to allow users to configure the device.

In an alternate embodiment, other knock detection devices may be used in addition to the piezo knock detector described.

In an alternate embodiment the system would include features to record successful or failed access attempts and communicate these to users via external applications, phone calls, text messages, emails, Tweets, social media updates.

In an alternate embodiment the system would include features to restrict or grant access by time of day or depending on the state of other types of communication with external applications.

Figure 10:
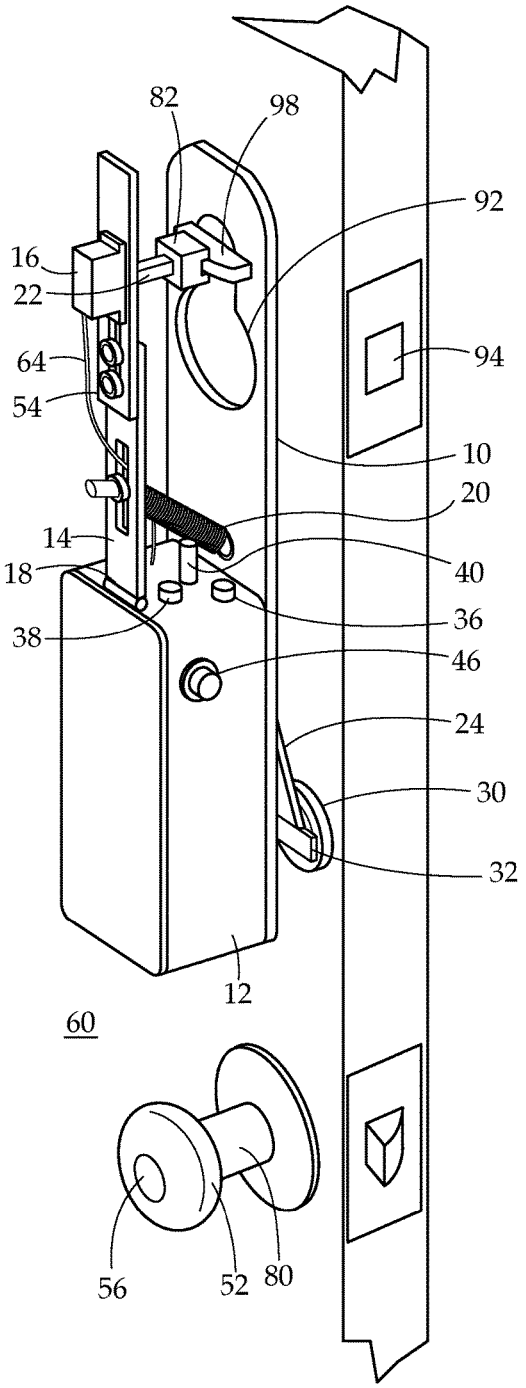
FIG. 10 is a view of an alternate embodiment of the system wherein the system is mounted on the rotational axis of the thumb turn lever on the interior of a locking deadbolt.
Figure 11:
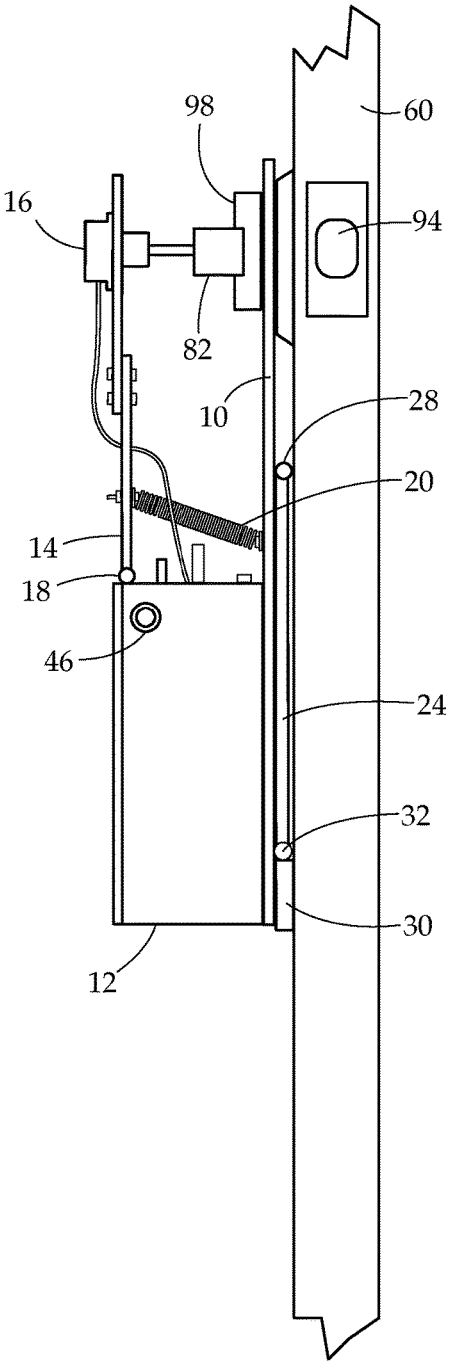
FIG. 11 is a side view of an alternate embodiment of the system wherein the system is mounted on the rotational axis of the thumbturn lever on the interior of a locking deadbolt.

An alternate embodiment of the system is illustrated in FIGS. 10 and 11. These illustrations display the system attached to a locking deadbolt. The device is attached to the deadbolt thumb turn axle 86. The deadbolt thumb turn lever 98 extends through the narrow portion of the slotted deadbolt mounting hole 92 so that the top of the narrow portion of the slotted deadbolt mounting hole 92 rests on the deadbolt thumb turn axle 86. The servo deadbolt mating coupler 82 is tensioned against the deadbolt thumb turn lever 98 via the servo tension arm 14 and servo tension arm spring 26. The servo deadbolt mating coupler 82 is shaped to conform to the shape of the deadbolt thumb turn lever 98 and to grasp the deadbolt thumb turn lever 98 snugly when tensioned against it via the servo tension arm 14 and servo tension arm spring 20. The servo deadbolt mating coupler 82 may be adjustable in size to accommodate different sized deadbolt thumb turn levers 98 and it may include a clamping mechanism to securely attach to the deadbolt thumb turn lever 98. The servo deadbolt mating coupler 82 transfers the rotational force of the servo motor 16 to rotate the deadbolt thumb turn lever 98 and unlock the deadbolt assembly to grant access.

Figure 12:
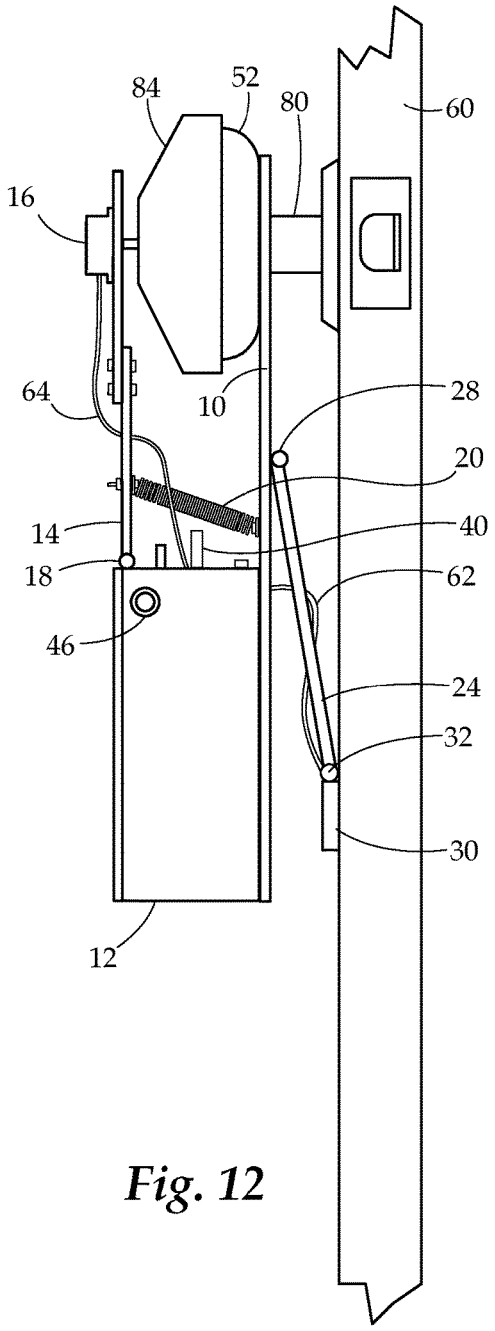
FIG. 12 is a side view of an alternate embodiment of the system wherein the system rotates the entire doorknob in order to grant access.

An alternate embodiment is illustrated in FIG. 12. This illustration shows how a servo door knob mating coupler 84 replaces the servo mating coupler 22. Instead of rotating only the finger operated rotational lock/unlock mechanism 56, the system utilizing the servo door knob mating coupler 84 will rotate the entire door knob 52 subsequent to a knock validated process. The servo door knob mating coupler 84 is tensioned against the door knob via the servo tension arm 14 and servo tension arm spring 20. The surface of the servo door knob mating coupler 84 which contacts the door knob 52 is shaped to fit the contour of the door knob 52 and is made of a non slip material so that the rotational forces of the servo motor 16 are transferred to the door knob 52 to rotate the door knob 52 to grant access. An alternate embodiment of the servo door knob mating coupler 84 would include a clamping mechanism to provide an additional mechanical connection between the servo door knob mating coupler 84 and the door knob 52.

Figure 13:
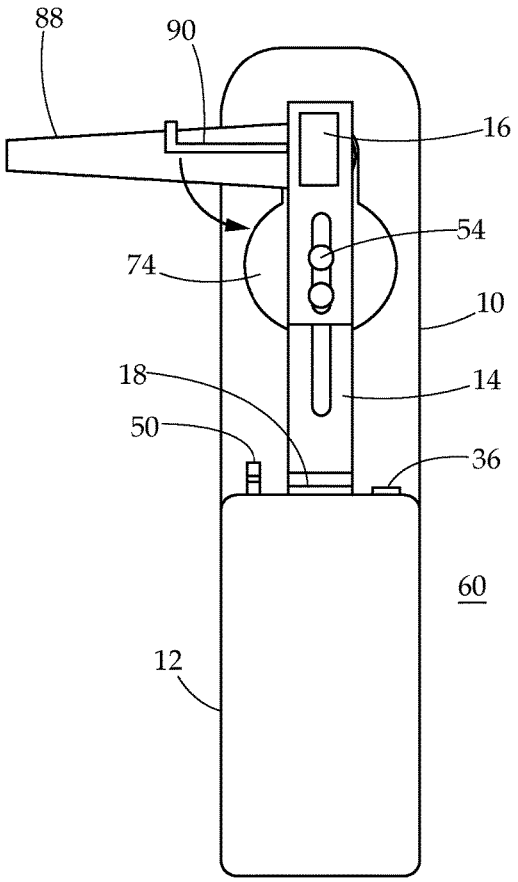
FIG. 13 is a front view of an alternative embodiment of the system wherein the system rotates the entire door lever in order to grant access.

An alternate embodiment is illustrated in FIG. 13. This illustration demonstrates how a servo door lever rotator arm 90 replaces the servo mating coupler 22. Instead of rotating only the finger operated rotational lock/unlock mechanism 56, the system utilizing the servo door level rotating arm 90 will rotate the entire door lever 96 after a knock is validated. The servo door lever rotator arm 90 is tensioned against the rotational axis of the door lever 96 via the servo tension arm 14 and servo tension arm spring 20. The rotational axis of the servo door lever rotator arm 90 is aligned with the rotational axis of the door lever 96.

The outer end of servo door lever rotator arm 90 extends at a ninety degree angle inward towards the door 60 to contact either the top or bottom surface of the door lever handle 88. When a knock is validated, rotation of the servo door lever rotator arm 90 transfers the rotational movement of the servo motor 16 to the servo door lever rotator arm 90 to rotate the door lever 96 and grant access. As in other embodiments described, the direction of rotation can be controlled by the rotational direction switch 48. Based on the desired rotation direction, the user may choose to initially mount the servo door level rotator arm 90 so that it makes contact with either the top or bottom surface of the door lever handle 88.

An alternate embodiment allows for two instances of the system to communicate with each other in order to share the lock validation features of one of the devices. This would be useful in a configuration where two instances of the system are connected simultaneously to both a door knob 52 or door lever 96 and a deadbolt assembly 94 attached to the same door 60. In such a configuration, the two systems could communicate via wired or wireless communication. In this configuration, a user would select which instance of the system would be responsible for knock validation as the "primary device" and which instance should be considered the "secondary device". The secondary device would not provide any knock validation, it would rely on the primary device to determine knock validation. The secondary device would take commands from the primary device and actuate the lock/unlock process based on commands from the primary device.

In an alternate embodiment, the system would be configured to so that the servo motors to unlock both a locking deadbolt and a door knob or door lever would be attached to a single system. This would allow a single system to unlock both a door knob or door lever and a locking deadbolt. In such a configuration, two servos may be mounted to a single servo tension arm or two separate servo tension arms may be used to provide the tension and positioning for the servo motor and the servo mating coupler, servo deadbolt mating coupler, or servo door knob mating coupler.

In conclusion, herein is presented a remote control locking and unlocking system. The invention is illustrated by example in the flow diagrams and figures, and throughout the written description. It should be understood that numerous variations are possible, while adhering to the inventive concept. Such variations are contemplated as being a part of the present invention.

What is claimed is:

1. A device configured for use with a door knob, a door lever, or a deadbolt, comprising:

- a frame comprising a flat platform and aperture for mounting over the door knob;
- an electronics container fixed to the frame comprising electronic components;
- a servo motor mounted via a slot to a servo tension arm and aligning with a rotational axis of a rotational lock mechanism;
- a servo mating coupler connected to the servo motor, configured to turn a finger operated rotational lock and the doorknob;
- a microcontroller that controls a behavior of said servo motor and other electronic components;
- a piezo knock detector converting vibrations resulting from pressure on a structure;
- a knock sensitivity adjustment knob used to filter out background vibrations;
- an audio mode switch controlling a generation of audio tones to communicate failed or successful access attempts;
- a programming switch allowing user input and storage of new knock patterns into an internal memory;
- a rotational direction switch controlling the servo motor's rotation; and
- a USB port mounted on a surface of the system to allow for software updates wherein the device is disposed to control the opening of the door knob or door level upon activation.

2. The device configured for use with a door knob, a door lever, or a deadbolt, of claim 1, wherein the electronics container further comprises a power switch, a rotational direction switch, a knock validation mode switch, a programming switch, a programming indicator light, and an audio mode switch.

3. The device configured for use with a door knob, a door lever, or a deadbolt, of claim 1, wherein a knock sensitivity knob is mounted within the electronics container.

4. The device configured for use with a door knob, a door level, or a deadbolt, of claim 1, wherein the servo tension arm is in communication with the electronics container via a hinge mechanism.

5. The device configured for use with a door knob, a door lever, or a deadbolt, of claim 1, wherein the piezo knock detector is attached to a piezo tension arm.

6. The device configured for use with a door knob, a door lever, or a deadbolt, of claim 5, wherein a piezo tension arm hinge is mounted to the piezo knock detector ensuring a maximum surface area of the piezo knock detector remains in contact with the door.

7. The device configured for use with a door knob, a door lever, or a deadbolt of claim 1, comprising:

a knock validation mode switch comprising:

a memory mode comparing a submitted knock pattern with a knock pattern stored in an internal memory; and an external mode initiating an HTTP request to an external application determining if access has been authorized within an external application.

8. The device configured for use with a door knob, a door lever, or a deadbolt, of claim 7, wherein matching of the submitted knock pattern with the knock pattern in the internal memory results in a servo motoring turning a servo deadbolt mating coupler.

9. The device configured for use with a door knob, a door lever, or a deadbolt, of claim 7 wherein a microcontroller interprets the HTTP response from the external application to determine authorization of the access.

10. The device configured for use with a door knob, a door lever, or a deadbolt, of claim 8 wherein a confirmation of authorization results in rotation of the servo motor, which rotates the servo mating coupler and turns a finger operated rotational lock and a doorknob.

11. The device configured for use with a door knob, a door lever, or a deadbolt, of claim 7 wherein a network connectivity indicator light indicates a status of the network connection when the system is set to external mode.

12. The device configured for use with a door knob, a door lever, or a deadbolt, of claim 7 wherein a user sequential pattern of knocks on the structure creates vibrations detected by a piezo knock detector.

13. The device configured for use with a door knob, a door lever, or a deadbolt, of claim 12 wherein the piezo knock detector converts vibrations to electrical energy and transfers said energy via wires to a microcontroller within an electronics container.

14. A control system attached to a locking deadbolt comprising:

a frame comprising a flat platform and aperture for mounting over a doorknob;

a deadbolt thumb turn axle;

a deadbolt thumb turn lever;

a slotted deadbolt mounting aperture comprising a narrow portion; wherein the deadbolt thumb turn lever extends through the narrow portion of the slotted deadbolt mounting aperture so that a top of the narrow portion of the slotted deadbolt mounting aperture rests on the deadbolt thumb turn axle;

a servo deadbolt mating coupler connected to the servo motor, capable of turning a finger operated rotational lock and a doorknob;

a servo tension arm;

a servo tension arm spring; and, a servo motor; wherein the coupler is tensioned against the deadbolt thumb turn lever via the servo tension arm and servo tension arm spring.

15. The control system attached to a locking deadbolt of claim 14 wherein the servo deadbolt mating coupler is shaped to conform to a shape of the deadbolt thumb turn lever and to grasp the deadbolt thumb turn lever snugly when tensioned against the deadbolt thumb turn lever via the servo tension arm and servo tension arm spring.

16. The control system attached to a locking deadbolt of claim 14 wherein the servo deadbolt mating coupler is adjustable in size to accommodate different sized deadbolt thumb turn levers.

17. The control system attached to a locking deadbolt of claim 16 further comprising a clamping mechanism securely attached to the deadbolt thumb turn lever.

18. The control system attached to a locking deadbolt of claim 14 wherein the servo deadbolt mating coupler is in mechanical communication with servo motor and disposed to transfer a rotational force of the servo motor to rotate the deadbolt thumb turn lever and unlock the deadbolt assembly.

* * * * *